US006148776A

United States Patent [19]

Liejonberg

[11] Patent Number: 6,148,776

[45] Date of Patent: Nov. 21, 2000

[54] BEARING ARRANGEMENT

[75] Inventor: Gunnar Liejonberg, Huskvarna, Sweden

[73] Assignee: Gul & Co Development AB, Huskvarna, Sweden

[21] Appl. No.: 09/228,286

[22] Filed: Jan. 11, 1999

Related U.S. Application Data

[63] Continuation of application No. PCT/SE97/01263, Jul. 10, 1997.

[30] Foreign Application Priority Data

Jul. 12, 1996 [SE] Sweden ..... 9602758
Dec. 23, 1996 [SE] Sweden ..... 9604837

[51] Int. Cl.[7] ..... F02B 75/06

[52] U.S. Cl. ..... 123/51 R

[58] Field of Search ..... 123/51 R, 55.2, 123/51 A, 51 B

[56] References Cited

U.S. PATENT DOCUMENTS 3,563,223 2/1971 Ishida ..... 123/51 R

*Primary Examiner*—Marguerite McMahon
*Attorney, Agent, or Firm*—Pillsbury Madison & Sutro LLP

[57] ABSTRACT

The present invention is for a bearing arrangement by a device for transmission of power where linear motion is transmitted into rotating motion or the like. The bearing means at the cam disc machine according to the invention is so made that the rotating cam disc is enclosed by a stationary housing whereby bearing between the stationary and rotating parts is arranged only on one side of the cylinder bore and in connection to the outgoing shaft.

6 Claims, 3 Drawing Sheets

BEARING ARRANGEMENT

This application is a continuation of Ser. No. PCT/SE97/01263 filed Jul. 10, 1997.

BACKGROUND

The present invention concerns a bearing arrangement for power transmission where linear motion is transmitted into rotating motion or reverse. The invention is primarily intended to be used for power machines such as combustion engines, pumps and compressors, but is not limited to this field of application.

Transmission of power from a reciprocating motion to a rotating motion generally is by means of some kind of crankshaft or the like device. In some cases however crankshafts are less suitable and this is especially the case when reciprocating motions of different, often directly opposite directions are transmitted into a rotating motion. Especially this holds for the kind of power machines where two pistons at the same time work against each other in a common cylinder bore or in cylinder bores which are in line with one another. In these cases the use of crankshafts brings with it complicated mechanical designs to put together the power from two or more pistons arranged in pairs to a common rotating motion. As an alternative to complicated transmissions, camshafts designs using a cam disc may be used, one such design is described in the Swedish patent application No 9601282-8, U.S. patent application Ser. No. 09/160,359.

In prior known designs the bearing is so made that there are bearings on both sides of a plane through the centre line or each pair of pistons. It follows from this that the device has throughgoing shafts or coaxially arranged shaft parts on both sides of the combustion chamber, which is common for the pistons.

SUMMARY

The present invention relates to a bearing by transmission of power from a reciprocating motion to a rotating motion in a cam disc machine. The invention and embodiments thereof have the characteristics which are mentioned in the claims.

The bearing device by the cam disc machine according to the invention is so made that the rotating cam disc is enclosed by a stationary housing whereby a bearing between the stationary and rotating parts is arranged only at one side of the cylinder bore and in connection to the outgoing shaft. In a preferred embodiment the bearing arrangement comprises two separated bearings. This can be deep groove ball bearings or other bearings without or with only a limited ability to absorb turning axially momentum forces, "consoleforces". In a preferred embodiment thereof the shaft and/or the device for mounting the shaft to the rotating disc are hollow, one bearing is arranged outside the shaft and one bearing is arranged inside the shaft or the mounting device. Preferably a line through the centre of the bearings extends through the centre of combustion or a corresponding point in the centre of the cylinder.

The bearing and the design arrangement in other aspects are so made that the shaft is affected by forces which cause the shaft rotate axially while, due to the symmetry of the construction, other forces which occur in the device cancel each other out in such a way that the shaft is not exposed to radially directed forces (i.e., bending moments) which may be termed "consoleforces". This makes it possible to use bearings of such a design which cannot absorb console forces or bending moments, for example comparatively simple deep groove ball bearings may be used. As there are no bending forces comparatively small bearings may be used also for large machines. The forces which shall be absorbed by the bearings is only the gravitation force, and other forces from the outside. The bearing shall thus be so arranged that the centre of combustion or a corresponding point in machines other than combustion engines is on a line through the centre of the bearings.

BRIEF DESCRIPTION OF THE DRAWINGS

The invention will below be described more in detail with reference to the embodiment which is shown in the enclosed figures.

DETAILED DESCRIPTION OF THE INVENTION

Figure 1:
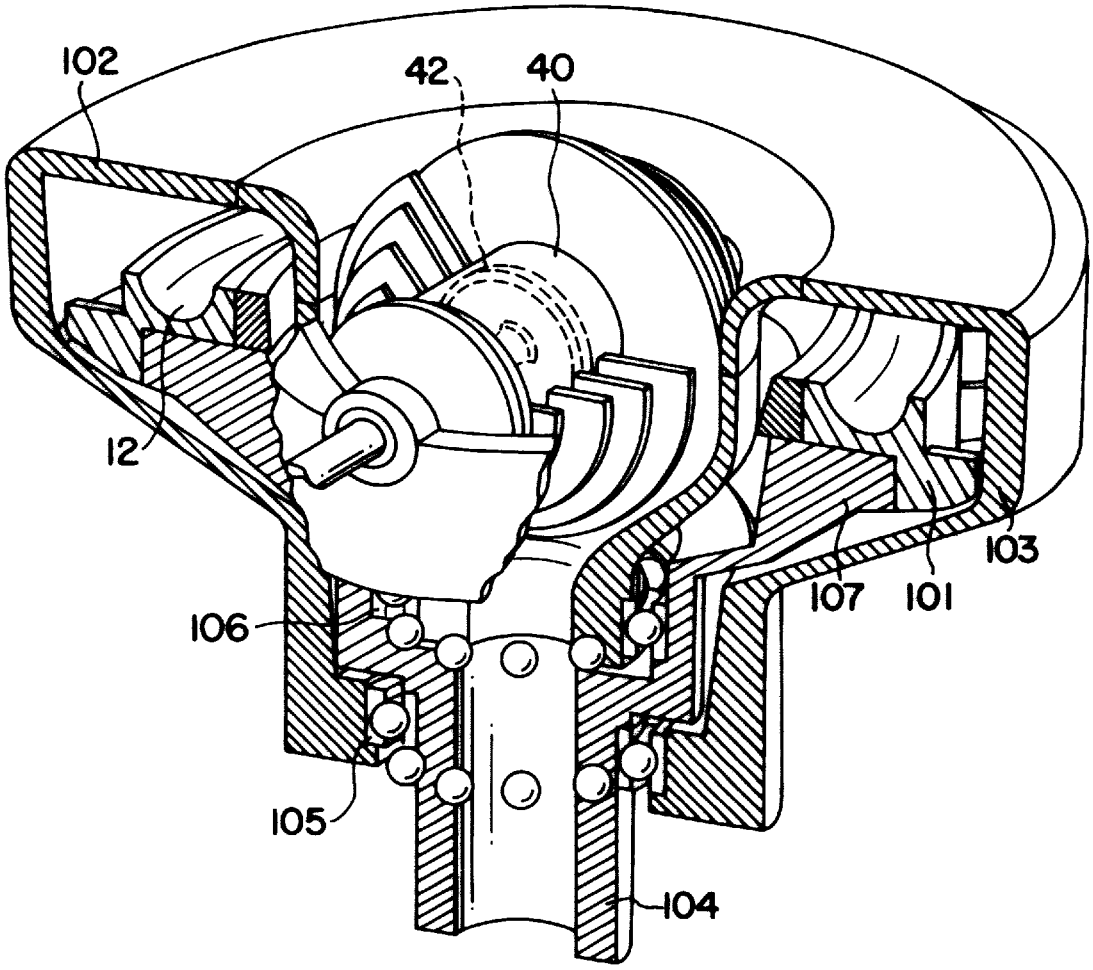
FIG. 1 is a perspective view of a cross-section of a device according to the invention.

The device shown in the figures comprises a cylinder bore 40 with two pistons 42 which work with a common combustion chamber. The linear reciprocating motion of the pistons 42 is transmitted to a rotating motion of the disc 101 in which there is a track 12. Closely thereto is a stationary disc 102 which has straight tracks 11, 24. Permanently joined to each piston 42 is a piston rod at the opposite end of which there is a holder means 17, 18 for the ball 34 which runs in the tracks and by which the power from the reciprocating motion is transmitted to the rotating disc 101. The ball holders 17, 18 are specially designed so that the transmission of power shall take place with the smallest losses possible and while avoiding uneven load. The design is then primarily directed to the phase of operation when the pistons at the combustion of fuel are forced away from each other and so exercise a force on the piston rods which by ball holder 17, 18 and balls 34 is transmitted to the rotating disc 101. In the other phases of operation the forces in the direction of the piston rod are lower. The tracks, balls and ball holders of the device are designed and dimensioned so that contact between the parts takes place not only at single points but along linear contact surfaces. In order to obtain the best efficiency and avoid uneven loads in the tracks in which the balls run, the contact surfaces ought to be formed as parts of great circles on the balls and be situated in the same plane or in planes at right angles to each other, as concerns forces and counterforces. This is obtained by special design of tracks and ball holders with adaptation to the application in question.

Figure 2:
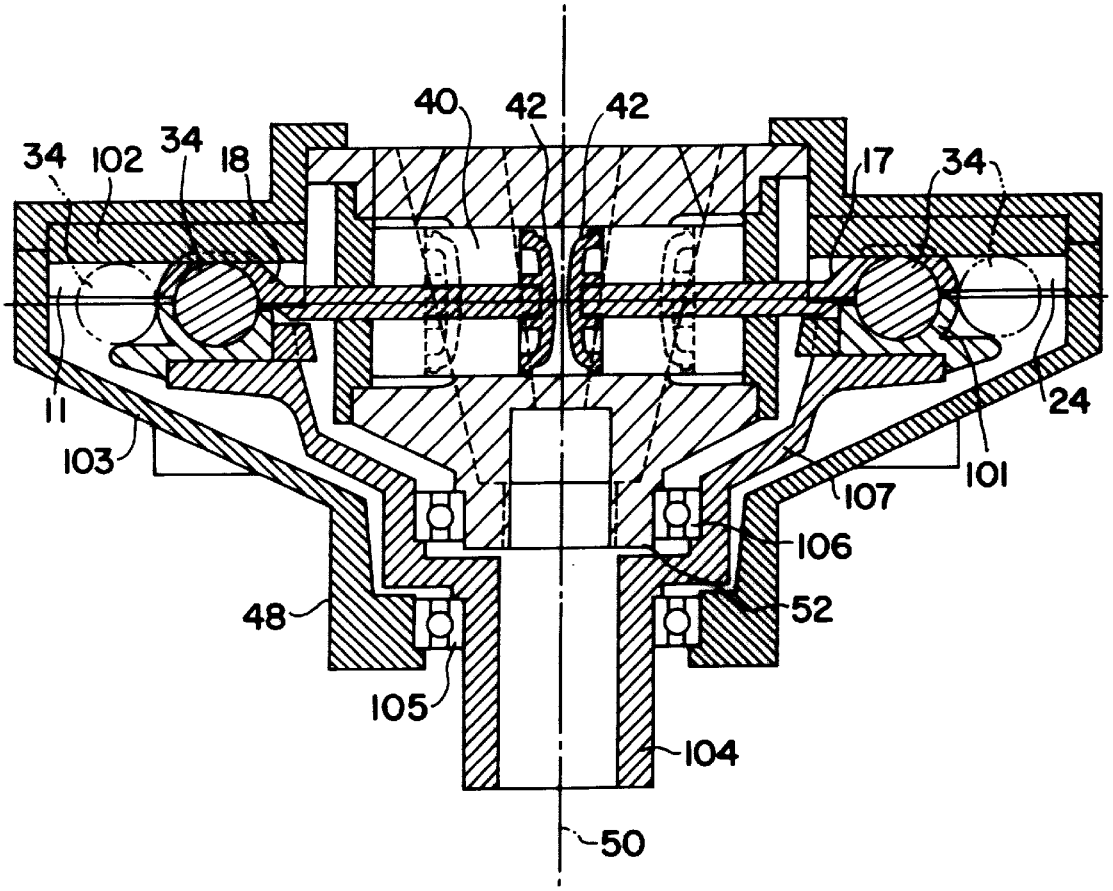
FIG. 2 is a cross-section of another embodiment of the invention.

The bearing arrangement of the rotating parts according to the invention is shown in FIGS. 1 and 2. In this embodiment the outgoing shaft 104 and also the connecting part 107, with which the shaft 104 is connected to the rotating disc 101, are hollow. For the application of the invention it is not necessary that the shaft 104 is hollow, but it is sufficient that the connecting part 107 is hollow, for example by being bowl-shaped as in the embodiments which are shown in the figures.

In the embodiment shown in FIGS. 1 and 2, two bearings 105, 106 are provided. As shown, bearings 105, 106 may comprise a plurality of ball bearings rotatably held between inner and outer races. Bearing 105 is disposed on an outer portion of shaft 104, between shaft 104 and an interior wall of a cylindrical extension 48 of a housing 103 enclosing the rotating disc 101 and connecting part 107. Bearing 106 is disposed inside an interior portion of the hollow connecting part 107, between connecting part 107 and a cylindrical projection 52 of the fixed inner structure of the device defining the bore 40.

Note that a centerline 50 of the bearings 105, 106 coincides with a center point of the bore 40 between the pistons 42. This may be a combustion chamber in an internal combustion engine.

Figure 3:
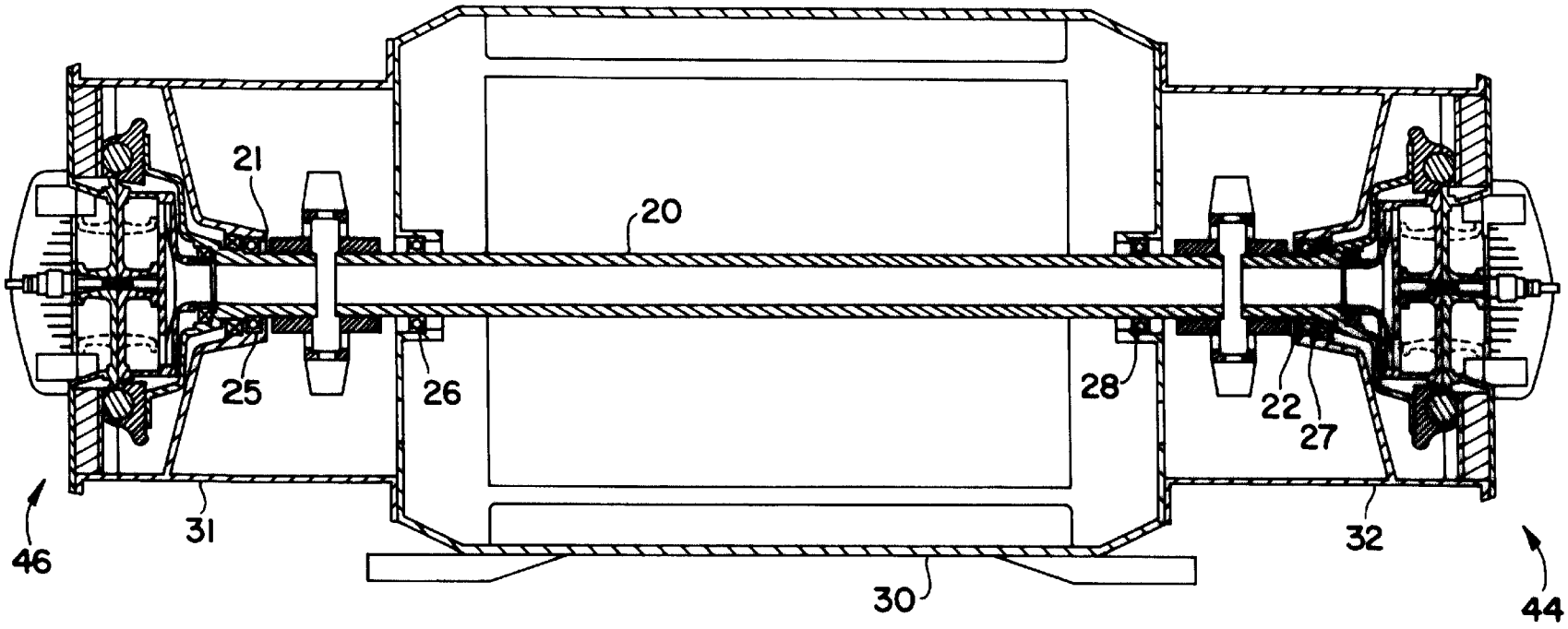
FIG. 3 is a cross-section of an embodiment where two engines have a common shaft.

In the embodiment shown in FIG. 3 two engines 44, 46 work with a common shaft 20 to drive a machine 30 which is positioned between the engines, for example an electric generator. The engines and the machine are built together into one unit which is air-cooled. In this embodiment air is taken in around the cylinder of each engine directed through the hollow shaft and further inside the housing which surrounds the machine which is driven by the engines. The bearing is common for both engines and the machine and comprises two inner bearings 26, 28 adjacent to the machine and two outer bearings 25, 27 closely adjacent to the engines. The housing 30 of the machine is fixedly joined to the housings 31, 32 which partly enclose each of the engines. The housings 31, 32 partly form a part of the housing 103 (see FIGS. 1 and 2) which is fixed to or forms a part of the stationary parts of the respective engine.

Also in this embodiment the bearing for the engines is thus arranged only in connection with the outgoing shaft and only at one side of the cylinder bore. This embodiment of the invention thus gives a very compact and space saving combustion engine driven electric generator which can be used for various purposes, for example hybrid vehicles.

The above specification relates to the embodiments which are shown in the figures. In other embodiments the rotating disc and the connecting part may for example be made in one piece and the bearing may be entirely between this piece and the stationary parts. The tracks may in some embodiments be substituted for by raised edges with contact surfaces for roll and slide bearings on the sides of the edge. Several engines may also in other ways be arranged together to drive for example a propeller shaft for an outboard engine for boats. It is then suitable that the outgoing shaft from each engine ends with a tooth-wheel which is included in a common worm gear.

What is claimed is:

1. A power machine comprising:

a common cylinder having a bore formed therein;

two pistons disposed in said bore in opposed facing relation with respect to each other and being constructed and arranged to synchronously reciprocate within said bore in opposite respective directions;

a transmission mechanism for converting linear reciprocating movement of said two pistons into a rotating movement, said transmission mechanism comprising:

a stationary disc;

a rotating disc, said rotating and stationary discs being operatively coupled to each other and to said two pistons to convert reciprocating movement of said pistons into rotation of said rotating disc; and an output shaft attached to said rotating disc by a connecting part;

a housing fixed to said stationary disc which at least partially encloses said rotating disc; and at least one bearing assembly rotationally supporting at least one of said shaft and said connecting part, wherein said output shaft and said connecting part extend to only one side of said common cylinder so that said at least one bearing is disposed on said one side of said common cylinder.

2. The power machine of claim 1, comprising two bearing assemblies disposed on only one side of said common cylinder.

3. The power machine of claims 2, wherein said shaft is hollow and a one of said bearing assemblies is carried on an outer surface of said shaft and the other of said bearing assemblies is carried inside said shaft.

4. The power machine of claims 2, wherein said connecting part is hollow and a one of said bearing assemblies is carried on an outer surface of said shaft and the other of said bearing assemblies is carried inside said connecting part.

5. The power machine of claim 1, wherein a centerline of said bearing assembly extends through a longitudinal center point of said bore of said common cylinder.

6. The power machine of claim 1, wherein said stationary disc and said rotating disc are disposed in a parallel arrangement with respect to each other, said stationary disc having fixed tracks formed therein extending from opposite ends of said bore and said rotating disc having a continuous, arcuate track formed therein and disposed in facing relation to said fixed tracks of said stationary disc, said rotating disc being of an annular construction with a central opening formed therein, whereby said common cylinder is disposed within said central opening and is surrounded by said arcuate track of said rotating disc, and wherein said transmission mechanism further comprises a ball associated with each of said pistons and disposed simultaneously in said arcuate track and a one of said fixed tracks and a ball holding assembly associated with each of said pistons and including a piston rod attached to and extending from said associated piston and a ball holder disposed on an end of said piston rod opposite said associated piston, said ball holder engaging a one of said balls to thereby transmit reciprocating motion of each associated piston to said ball to thereby cause rotation of said rotating disc.

* * * * *